US007222440B2

(12) United States Patent
Dombowsky

(10) Patent No.: US 7,222,440 B2
(45) **Date of Patent: *May 29, 2007**

(54) RESILIENT STRAP-ON SOLE COVER

(76) Inventor: Ben Dombowsky, 1182 Alder Avenue, Moose Jaw, Saskatchewan (CA) S6H 0Y7

( * ) Notice: Subject to any disclaimer, the term of this patent is extended or adjusted under 35 U.S.C. 154(b) by 292 days.

This patent is subject to a terminal disclaimer.

(21) Appl. No.: 10/792,386

(22) Filed: Mar. 4, 2004

(65) Prior Publication Data

US 2005/0193588 A1 Sep. 8, 2005

(51) Int. Cl.
*A43B 3/12* (2006.01)
*A43B 3/10* (2006.01)

(52) U.S. Cl. ..... 36/11.5; 36/7.5; 36/97; 36/7.1 R

(58) Field of Classification Search ..... 36/11.5, 36/7.5, 7.1 R, 7.4, 7.3, 7.7, 7.1 A, 96, 97, 36/15, 132
See application file for complete search history.

(56) References Cited

U.S. PATENT DOCUMENTS 946,846 A * 1/1910 McDonnell ..... 36/7.5
5,228,216 A * 7/1993 Sargeant ..... 36/11.5
5,836,090 A * 11/1998 Smith ..... 36/7.6
6,032,386 A * 3/2000 Evans ..... 36/15
6,237,250 B1 * 5/2001 Aguerre ..... 36/11.5
6,968,634 B2 * 11/2005 Dombowsky ..... 36/11.5
2002/0178620 A1 * 12/2002 Asciolla ..... 36/132

FOREIGN PATENT DOCUMENTS

CA 2421460 9/2003

* cited by examiner

*Primary Examiner*—Jila M Mohandesi
(74) *Attorney, Agent, or Firm*—Adrian D. Battison; Michael R. Williams; Ryan W. Dupuis

(57) ABSTRACT

A resilient anti-fatigue layer shaped to fit under the sole and heel of a shoe of a wearer includes a mat of fibers heat bonded together with a tight surface against the sole and a loose surface against the floor. The mat of fibers includes a generally flat portion shaped to match the bottom of the shoe and a plurality of tabs formed of the mat at the edges of the bottom portion and projecting beyond the edges of the bottom portion with at least one tab at the front, two tabs at the rear and at least one tab at each side, with each tab having attached thereto a respective strap. The straps provide a on each side a single strap which extends from the front side connection tab, through slots provided in a toe connection member to the rear side tabs, to the heel tabs and over the foot.

27 Claims, 6 Drawing Sheets

RESILIENT STRAP-ON SOLE COVER

The present invention relates to a resilient sole cover which can be strapped onto the shoe of a wearer for purposes of providing a layer between the shoe and a floor where the layer can provide additional resilience and/or an anti-slip effect.

BACKGROUND

There has been much research that shows a direct relationship between comfort, safety, and productivity in the workplace. In situations where long periods of standing exist, worker discomfort and fatigue can negatively impact productivity, absenteeism, and healthcare costs. Standing requires about 20 percent more energy than sitting. The foot is a very complex organ, a structure of 25 bones, or 12.5% of all the bones in the entire body, 56 ligaments, 38 muscles and over 7000 nerve endings. It is essential to recognize that your feet are sensitive parts of your body deserving good care. Being farthest from the heart, the feet generally have the poorest circulation in the body and this diminishes with age Depending on the floor surface and the amount of time workers are standing, employees can 'feel drained' and experience poor blood circulation in feet and legs. This may lead to serious consequences for health and safety at the work place. Beyond discomfort, pain and fatigue sets up the worker for further injuries affecting the muscles and joints. In addition an employee who is suffering from pain and fatigue is less alert and more likely to act in an unsafe manner.

Anti-fatigue mats have been designed to provide effective shock attenuation to address this problem. These mats are made of various materials including rubber, vinyl, wood and carpeting materials. By alleviating pressure, it can help stimulate blood circulation and possibly reduce stress of the lower back, leg joints, and major muscle groups. The result is an improved workplace with fewer occupational health complaints.

One anti-fatigue mat is available from 3M which is formed of a layer of intermingled course strands of heat bondable flexible plastics or rubber material which fibers are bonded together at crossing points to form an interconnected mat. One surface of the layer is relatively flat and the bonding effect is more pronounced with some of the strands clearly melted in the bonding process to form a tight surface while the other surface is looser and the strands less bonded together so that the strands are loose at the surface and stand out from the surface. This mat is commercially available and widely used as a floor covering for commercial floors for purposes of reducing fatigue in workers required to stand and work on the floor for extended time periods. The mat is applied to the floor surface such as concrete with the tight surface in contact with the floor and the loose surface facing upwardly. This mat is resistant to wear and to damage from commercial use including material spills and thus is widely used.

Many anti-slip soles are available for workplaces or exterior use but these are generally formed as a shoe to be worn on the foot of the wearer rather than as a strap on cover. Examples are manufactured by Shoes for Crews Inc. and Skid Busters. These provide soles with nubs or projections on the bottom surface which tend to be more slip resistant and tend to prevent or inhibit the accumulation of ice and snow.

One example of a strap on cover is shown in Canadian Application 2,421,460 by the present applicant which was published Sep. 11, 2003.

SUMMARY OF THE INVENTION

It is one object of the present invention to provide an improved apparatus which can be attached to the shoe of a wearer for providing a layer under the shoe sole on which the wearer can walk.

According to the present invention there is provided an apparatus comprising:

a resilient, flexible layer shaped to fit under the sole and heel of a shoe of a wearer;

the layer including an upturned rear portion for extending up the rear of the heel of the wearer;

a toe connection member at a toe end;

a left and a right forward side connection members one on each side at a forward location on the side;

a left and a right rearward side connection members one on each side at a location on the side rearward of the forward location;

a left strap portion extending from a left side of the upturned rear portion to the rearward side connection on a left side of the layer;

a right strap portion extending from a right side of the upturned rear portion to the rearward side connection on a right side of the layer;

a left strap extending from the left forward side connection to the toe connection member and from the toe connection member to the left rearward side connection and from the left rearward side connection to a left end connector flap;

and a right strap extending from the right forward side connection to the toe connection member and from the toe connection member to the right rearward side connection and from the right rearward side connection to a right end connector flap;

the left and right end connector flaps being arranged to connect and pull the left and right straps tight over the arch of the foot of the wearer.

Preferably the toe connection member comprises a single member generally central of the toe end which extends from the layer over the toe rearwardly of the toe end to a rear strap engaging portion.

Preferably the forward side connection members each include a portion which increases in width from the strap to the side of the layer so as to define a width at the layer which is wider than the strap to provide increased stability.

Preferably the left and right strap portions form a common strap extending around a top edge of the upturned rear portion Preferably each of the left and right rearward side connections includes a triangular connector which has a first side connected to a strap connector attached to the side of the layer, a second side over which the respective one of the left and right straps passes and a third side to which the respective one of the left and right strap portions connects Preferably each of the left and right rearward side connections is arranged closely adjacent the side of the layer so as to be below the top edge of the upturned rear portion of the layer.

Preferably the layer has a plurality of holes therethrough and wherein there is provided an anti-slip insert comprising a generally support member and a plurality of studs projecting from the support member downwardly therefrom, the support member being arranged to be located between the layer and the shoe with the studs projecting through the holes.

Preferably the support member and the studs are integrally molded from a plastics material.

Preferably the layer has a plurality of molded projecting elements on a bottom surface thereof shaped and arranged to define an anti-slip surface for the bottom surface.

Preferably the projecting elements form regularly arranged spaced projections.

Preferably the projections have formed therein narrow slots which are arranged across the projections to inhibit slip in a direction transverse to the slots.

Preferably the generally planar support member comprises a web with openings between the studs.

Preferably the studs are stiffer than the layer and have a length such that they to a position equal to or just extend beyond the bottom surface of the layer such that the wearer is supported from the ground on both the studs and the layer.

Preferably the studs have an axial metal insert extending therealong such that the studs are stiffer than the layer and have a length such that they to a position equal to or just extend beyond the bottom surface of the layer such that the wearer is supported from the ground on both the studs and the layer.

According to a second aspect of the invention there is provided an apparatus comprising:

a resilient flexible layer shaped to fit under the sole and heel of a shoe of a wearer, the layer having a plurality of holes therethrough;

straps connected to a front end, a rear end and sides of the layer for wrapping around the shoe of the wearer for attachment of the layer to the foot of the wearer;

and an anti-slip insert comprising a generally support member and a plurality of studs projecting from the support member downwardly therefrom, the support member being arranged to be located between the layer and the shoe with the studs projecting through the holes;

the support member and the studs being integrally molded from a plastics material.

According to a third aspect of the invention there is provided an apparatus comprising:

a resilient flexible layer shaped to fit under the sole and heel of a shoe of a wearer;

the layer having a plurality of molded projecting elements on a bottom surface thereof shaped and arranged to define an anti-slip surface for the bottom surface;

the layer having a plurality of spaced holes therethrough;

straps connected to a front end, a rear end and sides of the layer for wrapping around the shoe of the wearer for attachment of the layer to the foot of the wearer;

and an anti-slip insert comprising a generally support member and a plurality of studs projecting from the support member downwardly therefrom, the support member being arranged to be located between the layer and the shoe with the studs projecting through the holes.

BRIEF DESCRIPTION OF THE DRAWINGS

In the accompanying drawings, which illustrate an exemplary embodiment of the present invention.

DETAILED DESCRIPTION

A shoe covering comprises a base layer 10 which has a top surface 11 and a bottom surface 12 so that it can be placed underneath the shoe of a wearer with the sole of the shoe on the upper surface 11 and the bottom surface 12 placed onto the ground.

The layer 10 may be formed of a single layer of a resilient rubber or similar material or may be formed of two sub-layers 10A and 10B (FIG. 6) where the upper sub-layer 10A is formed of a resilient foam and the lower layer 10B of a less compressible material.

A strapping arrangement generally indicated at 13 is provided which acts to hold the covering in place on the shoe during activity by the wearer. It is of course particularly important that the layer remain properly in place and cannot slip forwards or rearwards or side to side as the wearer walks and carries out other activities since otherwise the device will rapidly become displaced, uncomfortable or even dangerous.

Figure 4:
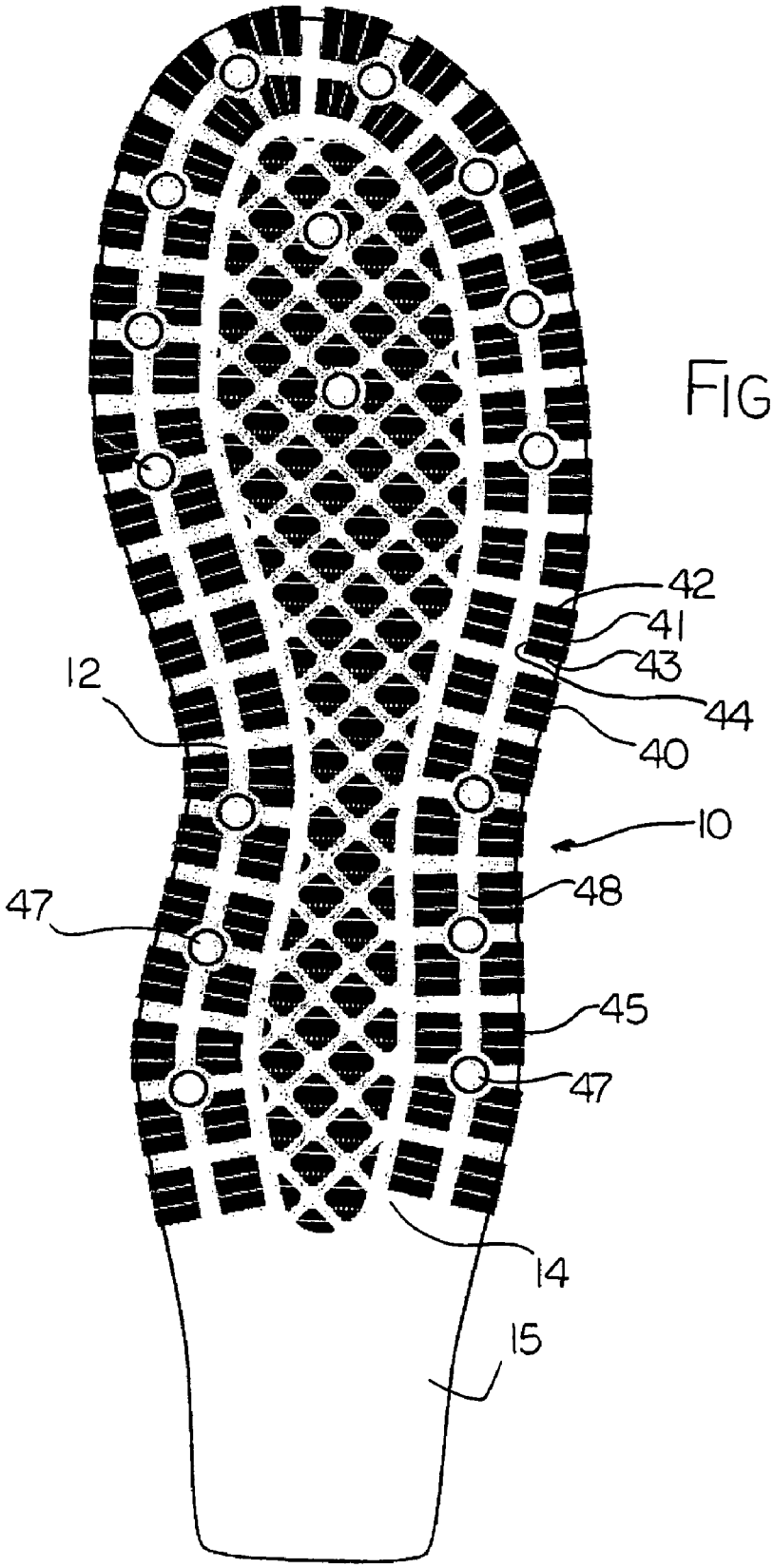
FIG. 4 is a bottom plan view of the embodiment of FIG. 1.

As shown in FIG. 4, the layer 10 is shaped so as to match the bottom of the sole and heal of the shoe of the wearer terminating in a rear edge 14 but also includes a rear upturned portion 50. The portion 15 is arranged to extend up behind the heal of the shoe of the wearer so as to define a top edge 16 which is behind the heal. The outside surface therefore of the upturned portion is not intended to engage the ground and therefore does not necessarily include ground engaging projections as described herein after.

The layer can be simply cut from a sheet of material but more preferably in the arrangement shown is formed by moulding so as to define a moulded shape to the bottom surface 12 and to side edges 17 which stand upwardly from the bottom surface 12 and define a shallow strip 18 around the side edges.

Also into the side edges is moulded a front toe portion 19 and side fastenings 20 and 21.

The toe portion 19 fastens at the front edge of the layer 10 and forms an upstanding portion 22 for extending over the toe of the shoe of the wearer. At the top of the upstanding portion forms a rearwardly extending portion 23 in the form of a tong which extends rearwardly over the top of the shoe to a connection portion 24 approximately at the rear of the toe cap of a conventional pair of shoes that is that the base of the laces.

The toe portion is formed from plastics material and is moulded to form the shape shown and to define a triangular opening 25 at the connection portion.

The side connecting portions 20 each are moulded into the side edge and form a bottom edge 26 which extends along the side strip 17 so as to have a wide connection at the base and tapers inwardly and upwardly to form an upper connecting portion 27 for connection to a side strap 28. The bottom end of the strap 28 is moulded into the side piece. The side piece 26 forms a front side connecting portion for connection to the right side strap 28. A symmetrical arrangement is provided on the opposite side.

A rear side connection 30 is provided at a position partway between the upturned rear and the front side connection and provides a strap which is moulded into the side flange 17. The strap forms a short connection for receiving a triangular connecting piece 31 at the rear side connection. The triangular connecting piece 31 thus forms three separate sides for receiving the ends of three straps. At the bottom is provided the strap connection 30 which holds onto and supports the bottom of the triangular connection 31. At the rear of the triangular connection is provided a rear strap portion 33 which extends from the rear part of the triangular connector upwardly and rearwardly to the top edge of the upturned rear portion 16. The strap portion 33 forms a part of a single strap which is attached around the top edge of the up turned portion and extends around to the left side to engage the symmetrical triangular connector on the left side. Thus the strap portion 33 pulls the top edge of the upturned portion rearwardly and downwardly to hold it connected to the side to prevent the rear portion from tending to slide downwardly over the heal of the wearer. The front portion of the triangular connector receives the strap 28.

Figure 1:
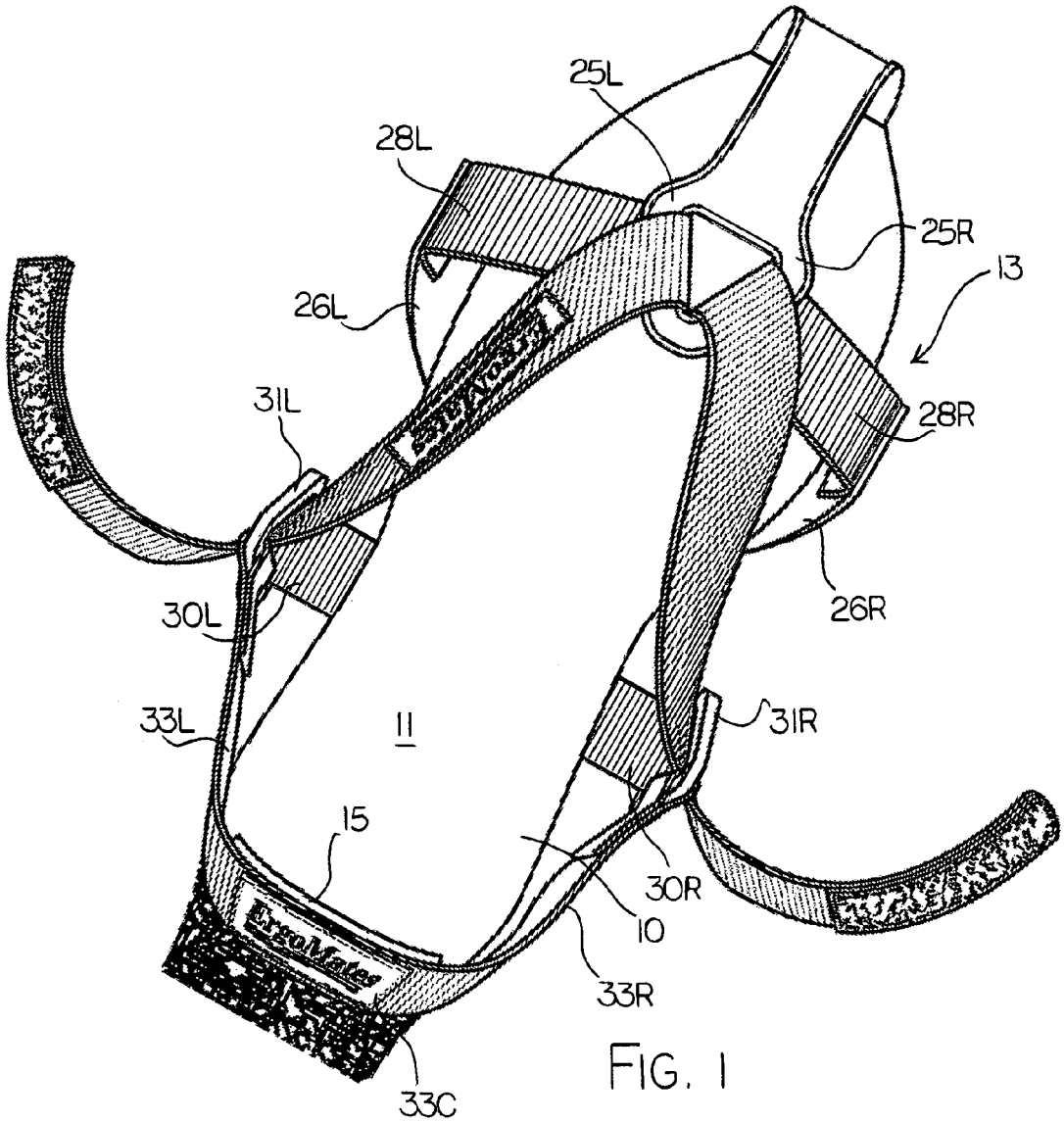
FIG. 1 is a top plan view of an embodiment according to the present invention showing the straps in an open position.
Figure 2:
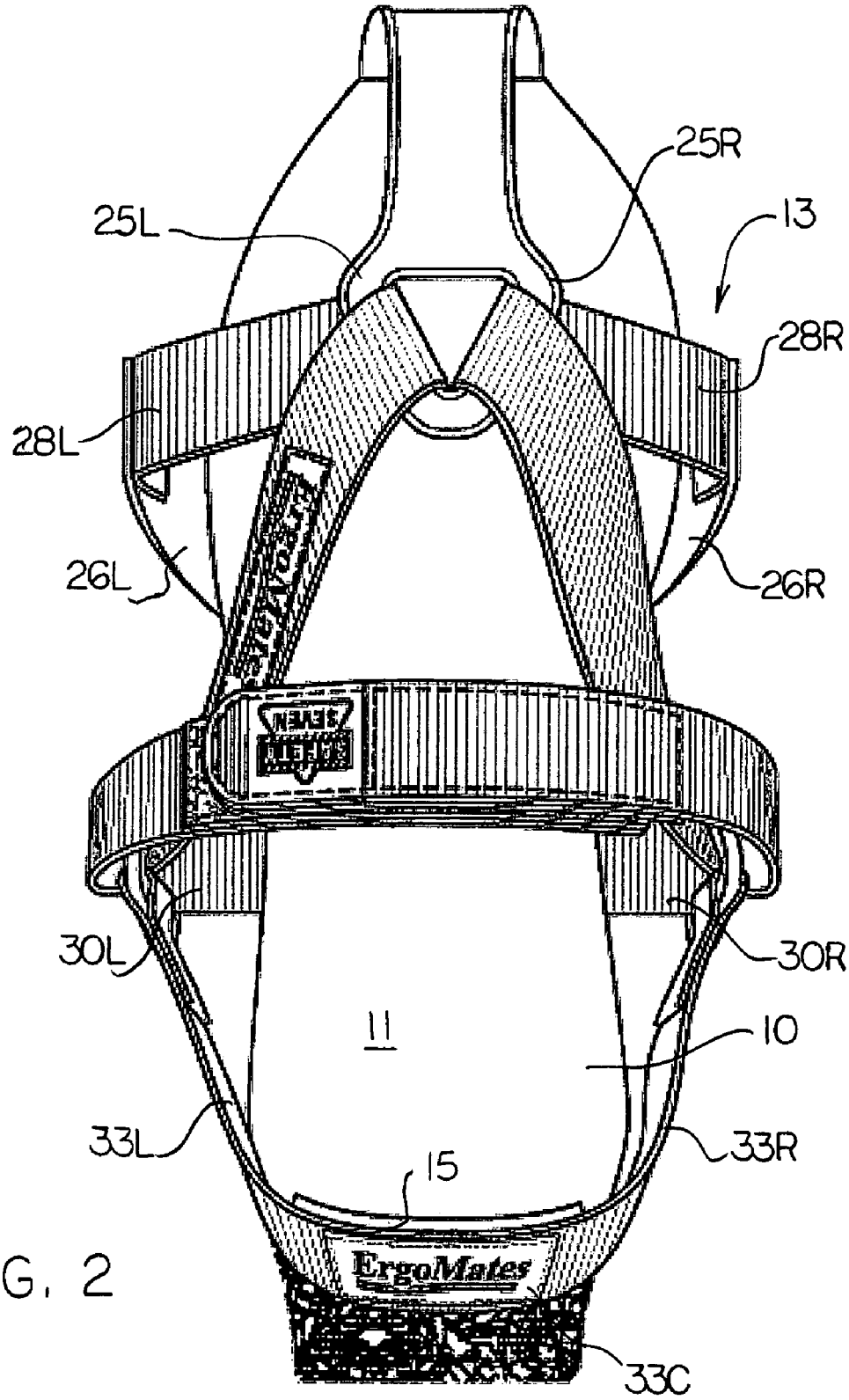
FIG. 2 is a top plan view of the embodiment of FIG. 1 showing the straps in the closed position.
Figure 3:
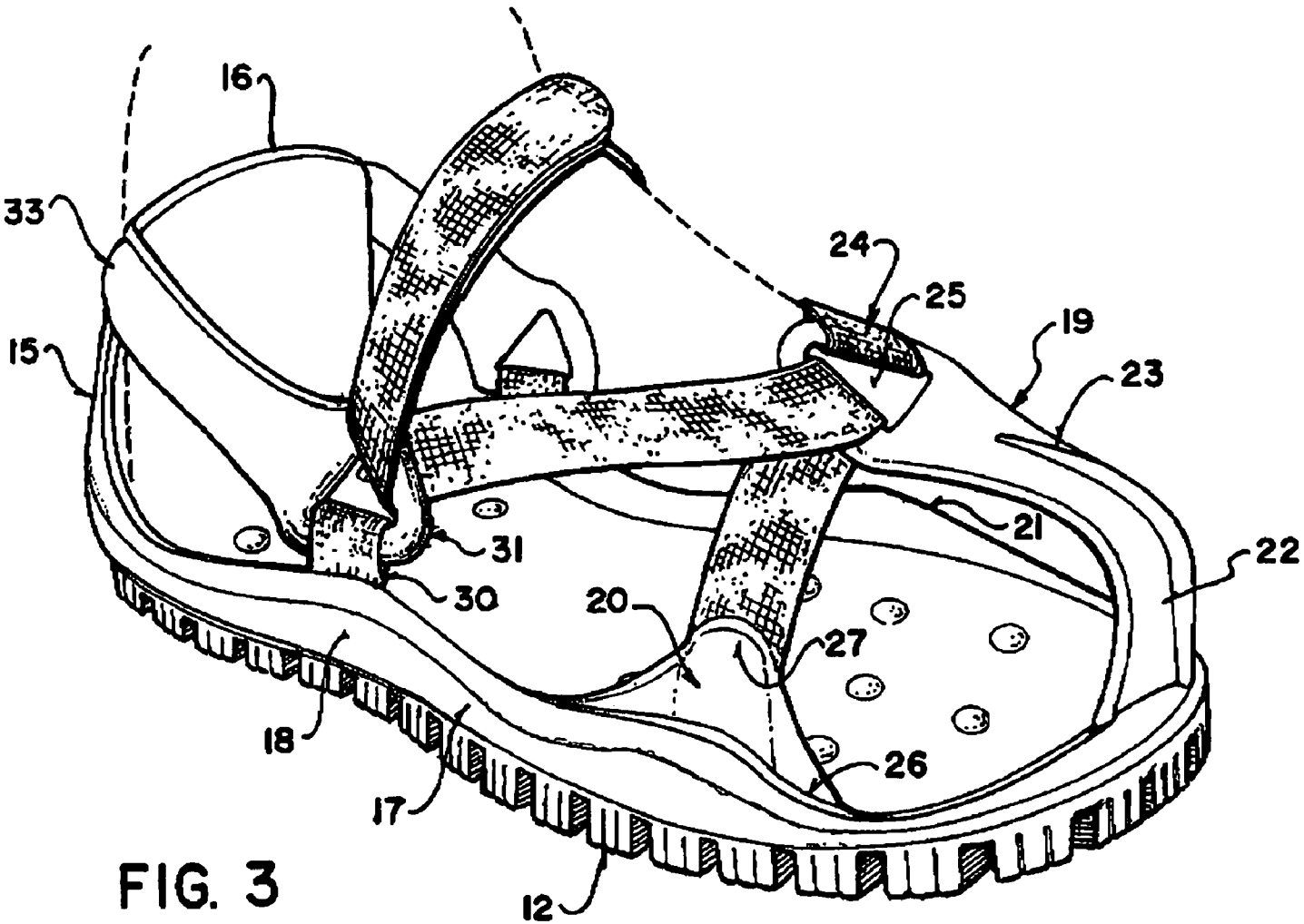
FIG. 3 is a side elevational view of the embodiment of FIG. 1.

Thus as best shown in FIG. 1, the construction is generally symmetrical so as to provide left and right components which are substantially symmetrical on each side of the layer thus the rear portions include rear strap portions 33R and 33L which connects around the top of the upturned portion 15 to form a connector 33C. The triangular connectors 31 are shown at 31R and 31L. The connecting strap portions 30 are shown at 30R and 30L. the front side connectors 26 are shown at 26R and 26L. The toe piece has side engaging elements at the connector 25 on the left and right as indicated at 25R and 25L. There are left and right side straps 28R and 28L.

The straps 28R and 28L thus extend from an end connected to the front side connector 26R through the support 25R of the toe piece down and to the side to the front edge of the triangular connector 31R and back over the arch of the foot of the wearer. The straps on the left and right connect together over the arch by suitable fastening such as hook and loop fasteners. The fact that the straps extend over the arch from the side of the foot at the rear side connector ensures that there is no tendency to pull back on the ankle of the wearer but instead the strap extends comfortably over the arch in front of the top of the shoe of the wearer.

The arrangement as shown provides a convenient readily attachable strapping arrangement which allows the wearer to place the shoe rapidly into the opening with the straps open and then to pull the straps tight on both side over the foot to hold the layer in place.

Turning now to FIG. 4, the underside of the sole is moulded to form a plurality of individual projecting elements 40 which are arranged in rows over the sole area. Each of the projecting elements is generally rectangular with a side 41, front edge 42, a rear edge 43 and a second side 44. The sides are generally parallel to the longitudinal centre line of the layer. Thus the front and rear edges are transverse to the centre line and thus lie transverse to the direction of force of the wearer when pushing off in a walking action to walk along the line of the shoe. Each projection has formed across its width a plurality of slots 45 which are parallel to the front and rear edges. These slots are relatively narrow and provide flexibility for the moulded projection so that slots can tend to open if the projection is flexed by the longitudinal force on the projection. As shown in FIG. 4 the projections include two rows of projections around the outside periphery of the bottom surface 12 with the projections spaced by channels therebetween. In a central area there is provided an array of projections which are again rectangular but arranged diagonally again with channels therebetween. The channels are shaped so that they are tapered so that the width of the channel narrows towards the base thus allowing material to slip out of the channel if collected therein when the layer flexes during walking or other movement.

The layer has a plurality of holes 47 at spaced positions around the layer and as shown primarily in the channel 48 which extends between the outer 2 rows of the projections. Thus a slightly larger space is provided between the projections in the channel 48 which allows the provision of a hole through the layer. The hole moulded into the layer so that a small portion of each projection is cut away to allow the provision of the hole within the channel.

Figure 5:
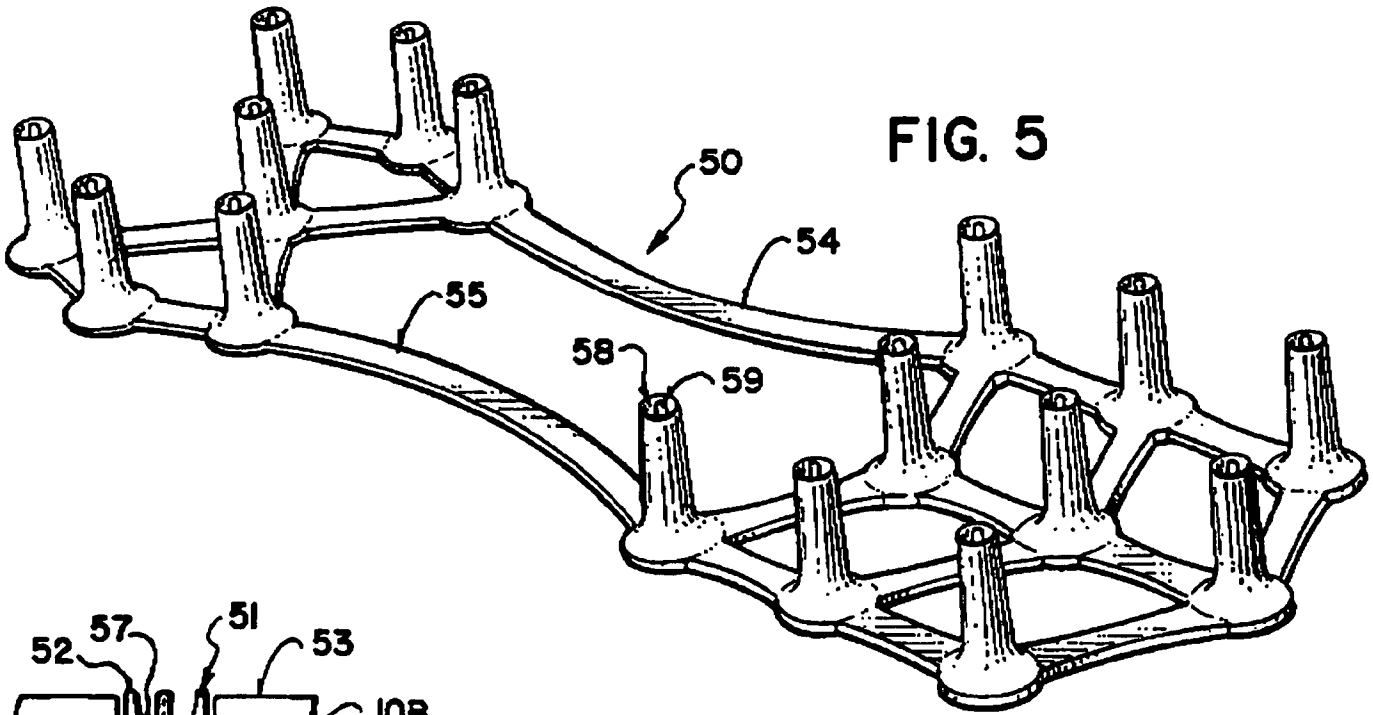
FIG. 5 is an isometric view of an anti-slip insert for use particularly in the arrangement shown in FIGS. 3 and 4.
Figure 6:
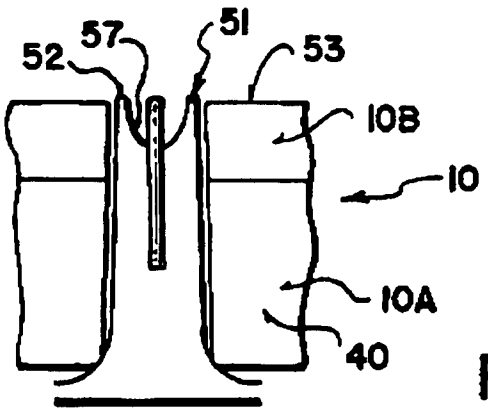
FIG. 6 is a cross sectional view of one stud of the insert of FIG. 5.

In FIG. 5 is shown an anti-slip insert which can be inserted between the sole of the shoe and the top of the layer so as to project through the holes to provide additional engagement with the ground. The insert 50 is moulded from a stiffer plastics material than the resilient layer so that the projections can engage the ground and bit into the ground even though the height of the projections is substantially equal to the height of the bottom surface of the layer. Thus as shown in FIGS. 5 and 6 which are inverted for convenience of illustration, the projections are indicated at 51 and they have a top surface 52 which is substantially coincident with the top surface 53 of the projections 40 of the layer. The projections 51 of the insert 50 are connected together by a web 54 which is integrally moulded with the projections to form a series of connecting legs 55 which extends from one projection to the next leaving large openings between the legs in the web construction. Thus simple enough material is cast into the planar web 54 to hold the projections connected. The projections thus extend through respective holes and the planar web 54 sits between the top surface of the layer and the sole of the shoe. The web is relatively thin and its thickness is absorbed into the resilience of the layer so that its presence is not appreciable by the wearer. The wearer therefore feels as if there are walking on the whole surface of the layer rather than merely on a series of projections which would be uncomfortable under the feet. Each of the projections is moulded from the stiff plastics material but includes a metal insert pin 56 which is inserted into the mould along an axis of each projection so as to provide an additional rigid engagement element which engages the ground in an anti-slip action. The top surface of each projection can thus be moulded into a recess or semi circle 57 which provides engagement with the ground provided by an outer ring 58 and the metal tip 59 of the metal pin 56 in the centre of the ring. This arrangement provides effective gripping action on the ground with sufficient force obtained simply by depressing the projections of the layer which are resilient so as to reduce the force on the layer and increase the force on the stiffer projections of the anti-slip insert 50.

It will be appreciated that the insert 50 can be readily placed onto the layer when the shoe is removed from the layer and pushed through the holes to take its place. When required to be removed, one end of the insert can be grasped at the web 54 pulling the projections out of the holes and removing the insert from the layer so that the layer can be used again with the insert.

The use of the insert depends upon the amount of slip on the ground so that in icy conditions where extra grip is required, the insert can be used. On hard surfaces such as oily or greasy concrete or other solid floor, the insert can be removed since it is of less value when the surface is rigid such as concrete.

The use of the layer which is a strap on arrangement for attachment to the sole of the shoe of the wearer provides the possibility for the sole to be manufactured from a more resilient, less wear resistant material since the sole can be readily replaced in view of the fact that it is relatively cheap in comparison with complete shoes where the upper also must be replaced. Thus an improved anti-slip arrangement can be provided with the projections on the underside of the layer since they can be formed from a material which provides the maximum anti-slip ability without concern for the increased rate of wear which is therefore obtained. The layer with the simple strapping arrangement can thus be readily discarded when the wear of the projections of the layer exceeds an acceptable limit.

Figure 7:
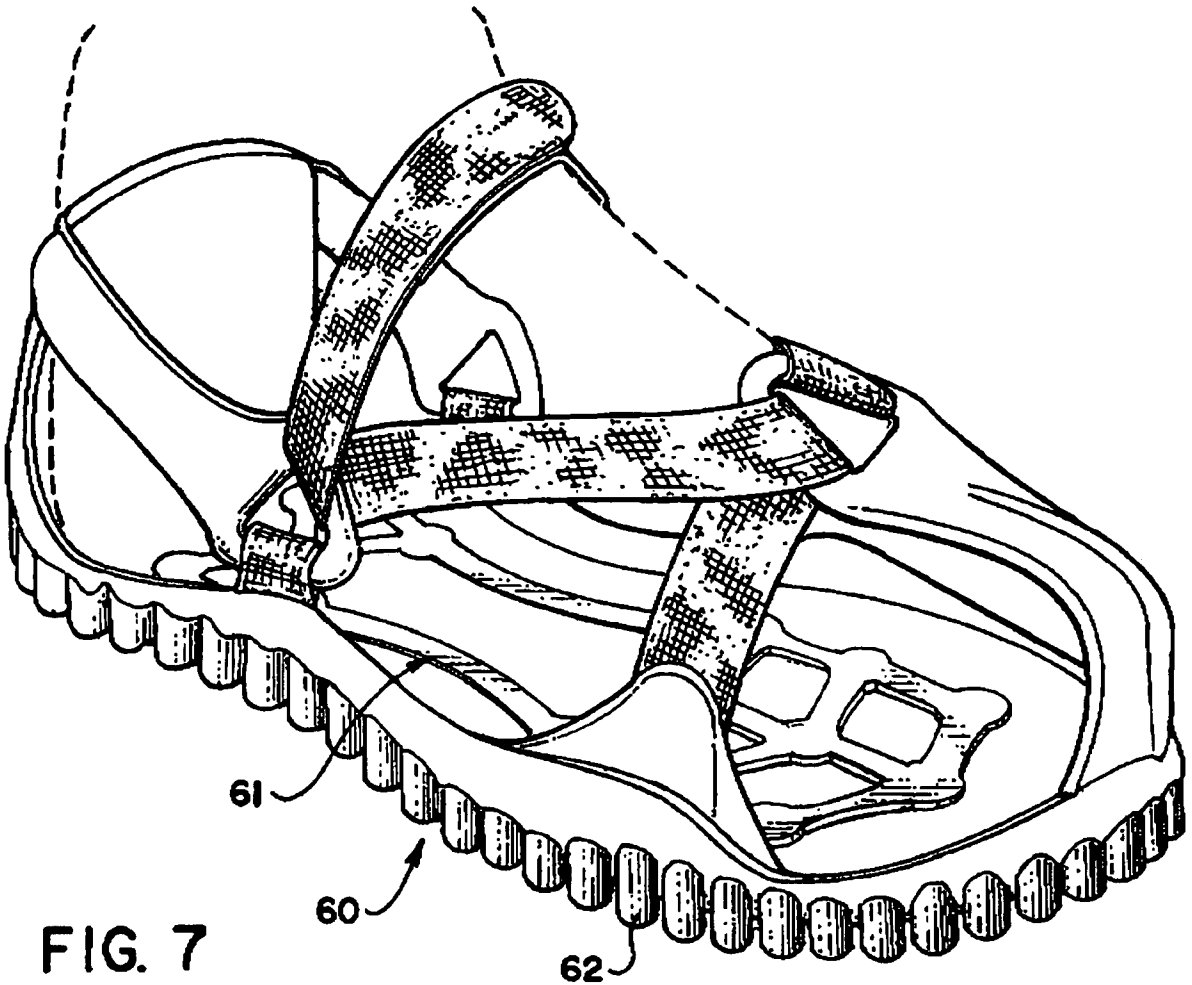
FIG. 7 is an isometric view similar to FIG. 3 of a second embodiment according to the present invention.

In FIG. 7 is shown a further modified arrangement where the layer is indicated at 60 and the insert at 61. In this arrangement the layer has a bottom surface which is defined by a plurality of evenly spaced cylindrical projections or nubs 62 which project from the bottom surface of the layer for engaging the ground. The nubs thus can individually flex slightly and provide an outside edge which is circular and thus provides a whole series of edges in all directions which can bite into the ground to provide an anti-slip effect. A number of the cylindrical nubs or projections are omitted to provide holes for receiving the projections of the insert which is of the construction shown in FIGS. 5 and 6.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claim is:

1. Apparatus comprising:

a foot shaped base layer shaped to fit under the sole and heel of a shoe of a wearer;

an upstanding heel connection portion standing upwardly from the base layer at a rearwardmost heel end of the base layer so as to stand upwardly behind the shoe of the wearer of the wearer;

an upstanding toe connection member standing upwardly from the base layer at a forwardmost toe end of the base layer so as to stand upwardly in front of the shoe of the wearer a left and a right forward side connection members one on each side at a forward location on the side of the base layer so as to be located to a respective side of the of the shoe wearer;

a left and a right rearward side connection members one on each side at a location on the side of the base layer rearward of the forward location so as to be located to a respective side of the shoe of the wearer;

a left strap portion extending from a left side of the upstanding heel connection portion to the left rearward side connection;

a right strap portion extending from a right side of the upstanding heel connection portion to the right rearward side connection;

a left strap extending from the left forward side connection to the toe connection member and from the toe connection member to the left rearward side connection and from the left rearward side connection to a left end connector flap;

and a right strap extending from the right forward side connection to the toe connection member and from the toe connection member to the right rearward side connection and from the right rearward side connection to a right end connector flap;

the left and right end connector flaps being arranged to connect and pull the left and right straps tight over the arch of the foot of the wearer.

2. The apparatus according to claim 1 wherein the toe connection member comprises a single member generally central of the toe end which extends from the layer over the toe rearwardly of the toe end to a rear strap engaging portion.

3. The apparatus according to claim 1 wherein the forward side connection members each include a portion which increases in width from the strap to the side of the layer so as to define a width at the layer which is wider than the strap to provide increased stability.

4. The apparatus according to claim 1 wherein the left and right strap portions form a common strap extending around a top edge of the upturned rear portion.

5. The apparatus according to claim 1 wherein each of the left and right rearward side connections includes a triangular connector which has a first side connected to a strap connector attached to the side of the layer, a second side over which the respective one of the left and right straps passes and a third side to which the respective one of the left and right strap portions connects.

6. The apparatus according to claim 1 wherein each of the left and right rearward side connections is arranged closely adjacent the side of the layer so as to be below the top edge of the upturned rear portion of the layer.

7. The apparatus according to claim 1 wherein the layer has a plurality of holes therethrough and wherein mere is provided an anti-slip insert comprising a generally support member and a plurality of studs projecting from the support member downwardly therefrom, the support member being arranged to be located between the layer and the shoe with the studs projecting through the holes.

8. The apparatus according to claim 7 wherein the support member and the studs are integrally molded from a plastics material.

9. The apparatus according to claim 7 wherein the layer has a plurality, of molded projecting elements on a bottom surface thereof shaped and arranged to define an anti-slip surface for the bottom surface.

10. The apparatus according to claim 9 wherein the projecting elements form regularly arranged spaced projections.

11. The apparatus according to claim 10 wherein the projections have formed therein narrow slots which are arranged across the projections to inhibit slip in a direction transverse to the slots.

12. The apparatus according to claim 7 wherein the generally planar support member comprises a web with openings between the studs.

13. The apparatus according to claim 7 wherein the studs are stiffer than the layer and have a length such that they extend to a position equal to or just beyond the bottom surface of the layer such that the wearer is supported from the ground on both the studs and the layer.

14. The apparatus according to claim 7 wherein the studs have an axial metal insert extending therealong such that the studs are stiffer than the layer and have a length such that they extend to a position equal to or just beyond the bottom surface of the layer such that the wearer is supported from the ground on both the studs and the layer.

15. Apparatus comprising:

a resilient flexible layer shaped to fit under the sole and heel of a shoe of a wearer, the layer having a plurality of holes therethrough;

straps connected to a front end, a rear end and sides of the layer for wrapping around the shoe of the wearer for attachment of the layer to the foot of the wearer;

and an anti-slip insert separate from the shoe comprising a generally planar support member and a plurality of studs projecting from the support member downwardly therefrom, the support member being shaped and arranged to be located on top of the layer and underneath at least the sole of the shoe with the studs projecting through the holes;

the support member and the studs being integrally molded from a plastics material.

16. The apparatus according to claim 15 wherein the layer has a plurality of molded projecting elements on a bottom surface thereof shaped and arranged to define an anti-slip surface for the bottom surface.

17. The apparatus according to claim 16 wherein the projecting elements form regularly arranged spaced projections.

18. The apparatus according to claim 17 wherein the projections have formed therein narrow slots which are arranged across the projections to inhibit slip in a direction transverse to the slots.

19. The apparatus according to claim 15 wherein the generally planar support member comprises a web with openings between the studs.

20. The apparatus according to claim 15 wherein the studs are stiffer than the layer and have a length such that they to a position equal to or just extend beyond the bottom surface of the layer such that the wearer is supported from the ground on both the studs and the layer.

21. The apparatus according to claim 15 wherein the studs have an axial metal insert extending therealong such that the studs are stiffer than the layer and have a length such that they extend to a position equal to or just beyond the bottom surface of the layer such that the wearer is supported from the ground on both the studs and the layer.

22. Apparatus comprising:

a resilient flexible layer shaped to fit under the sole and heel of a shoe of a wearer;

the layer having a plurality of molded projecting elements on a bottom surface thereof shaped and arranged to define an anti-slip surface for the bottom surface;

the layer having a plurality of spaced holes therethrough;

straps connected to a front end, a rear end and sides of the layer for wrapping around the shoe of the wearer for attachment of the layer to the foot of the wearer;

and an anti-slip insert separate from the shoe comprising a generally planar support member and a plurality of studs projecting from the support member downwardly therefrom, the support member being shaped and arranged to be located on top of the layer and underneath at least the sole of the shoe with the studs projecting through the holes.

23. The apparatus according claim 22 wherein the projecting elements form regularly arranged spaced projections.

24. The apparatus according to claim 23 wherein the projections have formed therein narrow slots which are arranged across The projections to inhibit slip in a direction transverse to the slots.

25. The apparatus according to claim 22 wherein the generally planar support member comprises a web with openings between the studs.

26. The apparatus according to claim 22 wherein the studs are stiffer than the layer and have a length such that they extend to a position equal to or just beyond the bottom surface of the layer such that the wearer is supported from the ground on both the studs and the layer.

27. The apparatus according to claim 22 wherein the studs have an axial metal insert extending therealong such that the studs are stiffer than the layer and have a length such that they extend to a position equal to or just beyond the bottom surface of the layer such that the wearer is supported from the ground on both the studs and the layer.

* * * * *